United States Patent [19]

Lu

[11] 4,298,672

[45] Nov. 3, 1981

Best Available Copy

[54] TONERS CONTAINING ALKYL PYRIDINIUM COMPOUNDS AND THEIR HYDRATES

[75] Inventor: Chin H. Lu, Webster, N.Y.

[73] Assignee: Xerox Corporation, Stamford, Conn.

[21] Appl. No.: 911,623

[22] Filed: Jun. 1, 1978

[51] Int. Cl.[3] ..... G03G 9/08

[52] U.S. Cl. ..... 430/108; 430/109; 430/110; 430/120

[58] Field of Search ..... 252/62.1 P; 427/18; 430/108, 106, 109, 110, 120

[56] References Cited

U.S. PATENT DOCUMENTS

| | | | |
|---|---|---|---|
| 3,069,428 | 12/1962 | Fitzpatrick et al. | 252/357 |
| 3,632,617 | 1/1972 | Suzuki et al. | 252/62.1 P |
| 3,944,493 | 3/1976 | Jadwin | 252/62.1 P |
| 3,970,571 | 7/1976 | Olson et al. | 252/62.1 P |
| 3,985,664 | 10/1976 | Sakaguchi | 252/62.1 P |
| 4,007,293 | 2/1977 | Mincer et al. | 252/62.1 P |
| 4,079,014 | 3/1978 | Burness et al. | 252/62.1 P |

FOREIGN PATENT DOCUMENTS

| | | | |
|---|---|---|---|
| 2702526 | 7/1977 | Fed. Rep. of Germany | 252/62.1 P |
| 1181287 | 2/1970 | United Kingdom | 96/15 D |

*Primary Examiner*—Richard L. Schilling
*Assistant Examiner*—John L. Goodrow
*Attorney, Agent, or Firm*—E. O. Palazzo

[57] ABSTRACT

Disclosed is a positively charged developer comprised of a toner and an alkyl pyridinium compound and its hydrate of the formula

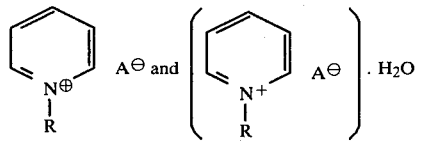

wherein A is an anion selected from halides such as chlorine, bromine, iodine, sulfate, sulfonate, nitrate and borate, and R is a hydrocarbon radical containing from about 8 to about 22 carbon atoms and preferably from 12 to 18 carbon atoms.

12 Claims, No Drawings

TONERS CONTAINING ALKYL PYRIDINIUM COMPOUNDS AND THEIR HYDRATES

BACKGROUND OF THE INVENTION

This invention is generally directed to new developers and the use of such developers for causing the development of images in an electrophotographic system. More specifically, the present invention is directed to new developers comprised of toners containing charge control agents primarily for the purpose of providing a positive charge on the toner material.

The electrophotographic process is well known as is documented in numerour prior art references including many patents. Generally, the process involves uniformly charging a photoconductive insulating surface which is placed on a conductive backing and subsequently exposing the photoconductive surface to a light image of the original to be reproduced. The photoconductive surface is prepared in such a manner so as to cause it to become conductive under the influence of the light image thus allowing the electrostatic charge formed thereon to be selectively dissipated to produce what is developed by means of a variety of pigmented resin materials specifically made for this purpose such as toner. Such toner materials are electrostatically attracted to the latent image areas on the plate in proportion to the charge concentration contained thereon. Thus, for example, in areas of high charge of concentration there is created areas of high toner density while in corresponding low charge images become proportionately less dense. Thereafter, the developed image is transferred to a final support material such as paper and fixed thereto for permanent record or copy of the original.

Many processes are known for applying the electroscopic particles or toner to the electrostatic latent image to be developed such as for example the development method described in U.S. Pat. No. 3,618,552, cascade development, U.S. Pat. Nos. 2,874,063, 3,251,706, and 3,357,402, magnetic brush development, U.S. Pat. No. 2,221,776, powder cloud development, U.S. Pat. No. 3,166,432, touchdown development. In magnetic brush development for example, a developer material containing toner and magnetic carrier particles is transported by a magnet within the magnetic field of the magnet causing alignment of the magnetic carrier into a brush-like configuration. This so-called magnetic brush is brought into close proximity of the electrostatic latent image bearing surface and the toner particles are drawn from the brush to the electrostatic latent image by electrostatic attraction.

In some instances it may be desirable in electrophotographic systems to produce a reverse copy of the original. Thus, for example, it may be desired to produce a negative copy from a positive original or a positive copy from a negative original. Generally this is referred to in the art as image reversal and in electrostatic printing such image reversal can be affected by applying to the image a developer powder which is repelled by the charged areas of the image and adheres to the discharged areas. More specifically, toners possessing positive charges are found to be very useful and effective in electrophotographic reversal systems and in particular in electrophotographic systems employing organic photoreceptors which in many instances are initially charged negatively rather than positively thus necessitating the need for a positively charged toner.

Reversal developers are described in U.S. Pat. No. 2,986,521, such developers being comprised of electroscopic material coated with finely divided colloidal silica. When this material is used in an electrostatic development system, development of electrostatic images on negatively charged surface is accomplished by applying the electroscopic material having a positive triboelectric relationship with respect to the colloidal silica.

In U.S. Pat. No. 3,893,935 there is described the use of certain quaternary ammonium salts as useful charge control agents for electrostatic toner compositions. According to the disclosure, certain quaternary ammonium salts when incorporated into toner materials were found to provide a particulate toner composition which exhibited relatively high uniform and stable net toner charge when mixed with a suitable carrier vehicle and which toner also exhibited a minimum amount of deleterious toner throw off. U.S. Pat. No. 4,079,014 contains a similar teaching with the exception that a different charge control agent is used, namely a diazo type compound.

Many of the described developers have a tendency to lose their positive charge over a period of time, are difficult to prepare and because of this the quality of the image that is to be developed is adversely affected over a period of time. Further, the use of charge control agents in developers as described in U.S. Pat. No. 3,893,935 are soluble in water causing them to be leached to the toner surface by moisture thereby adversely affecting the machine environment and the copy quality and further such toners containing these materials are humidity sensitive. Additionally these materials are incompatible with the thermoplastic resins and it is very difficult to uniformly disperse or dissolve such materials in the toner. This causes particle-to-particle non-uniformity and wide distribution of electrical charge which in turn reduces the quality of the image developed, and shortens the developer life.

Accordingly, there is a need for developer which can be used in a reverse system and specifically the need for a positively charged toner when used in systems requiring such toners allows the production of high quality images over a long period of use.

SUMMARY OF THE INVENTION

It is an object of this invention to provide a toner which overcomes the above-noted disadvantages.

It is a further object of this invention to provide a developer which contains toner and carrier with the toner being charged positively.

Another object of this invention is the provision of a developer which contains positive toner having improved humidity insensitivity and fast toner admix charging.

An additional object of the present invention is to provide developers containing toners and carriers of improved triboelectric charge which are resistive to moisture leaching.

Yet another important object of the present invention is the provision of developers which have rapidly fast charging rates and admix charging behaviors.

An additional object of this invention is to provide toners which will develop electrostatic images containing negative charges on the photoreceptor surface and which will transfer effectively electrostatically from such a photoreceptor to plain bond paper without causing blurring or adversely affecting the quality of the resulting image.

Another object of this invention is to provide charge control materials which are completely compatible with the toner resin.

A further object of the present invention is to provide developers containing toners which have improved particle-to-particle uniformity and narrow charge distribution, that is. These and other objects of the present invention are accomplished by providing developers comprised of a toner resin, colorant and an alkyl pyridinium compound, and its hydrate of the formula

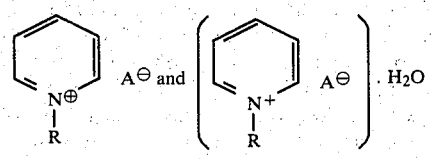

wherein A is an anion which in a preferred embodiment is selected from halides such as chlorine, bromine, iodine, sulfate, sulfonate, nitrate, and borate and R is a hydrocarbon radical containing from about 8 to about 22 carbon atoms and preferably from 12 to 18 carbon atoms. Illustrative examples of the hydrocarbon radicals include octyl, nonyl, decayl, myristyl, cetyl, olely, pentadecyl, heptadecyl and octadecly.

Illustrative examples of alkyl pyridinium compounds useful in the present invention include cetyl pyridinium chloride, heptadecyl pyridinium bromide, octadecyl pyridinium chloride, myristyl pyridinium chloride, and the like, as well as the corresponding hydrates. Other compounds not specifically listed herein may also be useful providing they do not adversely affect the system. The alkyl pyridinium compounds and their hydrates can be used in any amount that results in toner that is charged positively in comparison to the carrier and that develops and electrostatically transfers well. For example, the amount of alkyl pyridinium compound present ranges from about 0.1 weight percent to 10 weight percent and preferably from about 0.5 weight percent to 5 weight percent of the total toner weight. The alkyl pyridinium compound can be blended into the system or coated on a pigment such as carbon black which is used as a colorant in the developing composition.

Many methods may be employed to produce the toner of the present invention, one such method involving melt blending the resin and the pigment coated with the alkyl pyridinium compound followed by mechanical attrition. Other methods include those well known in the art such as spray drying, melt dispersion and dispersion polymerization. For example, a solvent dispersion of resin pigment and alkyl pyridinium compound are spray dried under controlled conditions thereby resulting in the desired product. Such a toner prepared in this manner results in a positive charged toner in relation to the carrier materials used and these toners exhibit the improved properties as mentioned herein.

While any suitable resin may be employed in the system of the present invention, typical of such resins are polyamides, epoxies, polyurethanes, vinyl resins and polymeric esterification products of a dicarboxylic acid and a diol comprising a diphenol. Any suitable vinyl resin may be employed in the toners of the present system including homopolymers or copolymers of two or more vinyl monomers. Typical of such vinyl monomeric units include: styrene, p-chlorostyrene vinyl napthalene, ethylenecally unsaturaged mono-olefins such as ethylene, propylene, butylene, isobutylene and the like; vinyl esters such as vinyl chloride, vinyl bromide, vinyl fluoride, vinyl acetate, vinyl propionate, vinyl benzoate, vinyl butyrate and the like; esters of alphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the like; and mixtures thereof.

Generally toner resins containing a relatively high percentage of styrene are preferred since greater image definition and density is obtained with their use. The styrene resin employed may be a homopolymer of styrene or styrene homologs of copolymers of styrene with other monomeric groups containing a single methylene group attached to a carbon atom by a double bond. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization techniques such as free radical, anionic and cationic polymerization processes. Any of these vinyl resins may be blended with one or more resins if desired, preferably other vinyl resins which insure good triboelectric properties and uniform resistance against physical degradation. However, non-vinyl type thermoplastic resins may also be employed including resin modified phenol-formaldehyde resins, oil modified epoxy resins, polyurethane resins, cellulosic resins, polyether resins and mixtures thereof.

Also esterification products of a dicarboxylic acid and a diol comprising a diphenol may be used as a preferred resin material for the toner composition of the present invention. These materials are illustrated in U.S. Pat. No. 3,655,374 totally incorporated herein by reference, the diphenol reactant being of the formula as shown in Column 4, beginning at line 5 of this patent and the dicarboxylic acid being of the formula as shown in Column 6 of the above patent. The resin is present in an amount so that the total of all ingredients used in the toner total about 100%, thus when 5% by weight of the alkyl pyridinium compound is used and 10% by weight of pigment such as carbon black, about 85% by weight of resin material is used.

Optimum electrophotographic resins are achieved with styrene butylmethacrylate copolymers, styrene vinyl toluene copolymers, styrene acrylate copolymers, polyester resins, predominantly styrene or polystyrene base resins as generally described in U.S. Pat. No. 25,136 to Carlson and polystyrene blends as described in U.S. Pat. No. 2,788,288 to Rheinfrank and Jones.

Any suitable pigment or dye may be employed as the colorant for the toner particles, such materials being well known and including for example, carbon black, nigrosine dye, aniline blue, calco oil blue, chrome yellow, ultramarine blue, DuPont oil red, methylene blue chloride, phthalocyanine blue and mixtures thereof. The pigment or dye should be present in the toner and in sufficient quantity to render it highly colored so that it will form a clearly visible image on the recording member. For example, where conventional xerographic copies of documents are desired, the toner may comprise a black pigment such as carbon black or a black dye such as Amaplast black dye available from the National Aniline Products Inc. Preferably the pigment is employed in amounts from about 3% to about 20% by weight based on the total weight of toner, however, if the toner color employed is a dye, substantially smaller quantities of the color may be used.

Any suitable carrier material can be employed as long as such particles are capable of triboelectrically obtaining a charge of opposite polarity to that of the toner particles. In the present invention in one embodiment that would be a negative polarity, to that of the toner particles which are positively charged so that the toner particles will adhere to and surround the carrier particles. Thus the carriers can be selected so that the toner particles acquire a charge of a positive polarity and include materials such as sodium chloride, ammonium chloride, ammonium potassium chloride, Rochelle salt, sodium nitrate, aluminum nitrate, potassium chlorate, granular zircon, granular silicon, methylmethacrylate, glass, steel, nickel, iron ferrites, silicon dioxide and the like. The carriers can be used with or without a coating. Many of the typical carriers that can be used are described in U.S. Pat. Nos. 2,618,441; 2,638,416; 2,618,522; 3,591,503; 3,533,835; and 3,526,533. Also nickel berry carriers as described in U.S. Pat. Nos. 3,847,604 and 3,767,598 can be employed, these carriers being modular carrier beads of nickel characterized by surface of reoccurring recesses and protrusions providing particles with a relatively large external area. The diameter of the coated carrier particle is from about 50 to about 1000 microns, thus allowing the carrier to possess sufficient density and inertia to avoid adherence to the electrostatic images during the development process.

The carrier may be employed with the toner composition in any suitable combination, however, best results are obtained when about 1 part per toner is used and about 10 to about 200 parts by weight of carrier.

Toner compositions of the present invention may be used to develop electrostatic latent images on any suitable electrostatic surface capable of retaining charge including conventional photoconductors, however, the toners of the present invention are best utilized in systems wherein a negative charge resides on the photoreceptor and this usually occurs with organic photoreceptors, illustrative examples of such photoreceptors being polyvinyl carbazole, 4-dimethylaminobenzylidene, benzhydrazide; 2-benzylidene-amino-carbazole, 4-dimethylamino-benzylidene, benzhydrazide; 2-benzylidene-aminocarbazole, polyvinyl carbazole; (2-nitro-benzylidene)-p-bromoaniline; 2,4-diphenyl-quinazoline; 1,2,4-triazine; 1,5-diphenyl-3-methyl pyrazoline 2-(4'-dimethyl-amino phenyl)-benzoxazole; 3-amino-carbazole; polyvinylcarbazole-tritrofluorenone charge transfer complex; phthalocyanines and mixtures thereof.

The following examples are being supplied to further define the species of the present invention, it being noted that these examples are intended to illustrate and not limit the scope of the present invention. Parts and percentages are by weight unless otherwise indicated.

EXAMPLE I

Toner A was prepared comprising 6 percent Regal 330 carbon black commercially available from Cabot Corporation, 2 percent of cetyl pyridinium chloride commercially available from Hexcel Company and 92 percent of styrene/n-butyl methacrylate (65/35) copolymer resin (XP 252 resin) by melt blending followed by mechanical attrition. Three parts per weight of this toner and 100 parts per weight of 0.35 percent perfluoroalkoxy fluoropolymer commercially available from DuPont Company coated on a Hoeganaes steel carrier were placed in a glass jar and roll mixed at a linear speed of 90 feet per minute for the time indicated in the following Table. The triboelectric charge of the toner was measured by blowing off the toner from the carrier in a Faraday cage.

| Roll Mixing Time | Toner Tribo μc/g (microcoloumbs per gram) |
|---|---|
| 5 min. | +38 |
| 10 min. | +38 |
| 1 hr. | +34 |
| 24 hr. | +33 |

The toner was fast charging against the carrier and the tribo was stable in the long mixing period.

The carbon black dispersion and particle-to-particle uniformity of this toner was examined by a transmission electron microscope technique and from this examination excellent quality was shown in both categories.

Toner A was classified to remove particles having average diameters below 5 microns. Three parts of the classified toner and 100 parts of 0.4 percent of perfluoroalkoxy fluorinated polymer coated Hoeganaes steel carrier were blended into a developer. Admix experiment indicated the developer had very fast charging characteristics and very narrow charge distribution. The developer was tested in a fixture using a photoreceptor charged negatively and good quality print with high optical density and low background were obtained.

EXAMPLE IA

Three parts of the classified Toner A and 100 parts of 0.2% Kynar 201, vinylidene fluoride resin available from Pennwalt Corporation, coated atomized steel carrier were blended into a developer. The developer was separately aged at low (about 20%) relative humidity and at high (about 80%) relative humidity for 24 hours. Tribo measurements showed there was no significant difference in triboelectric charge between the developers at low relative humidity and at high relative humidity, indicating the humidity insensitivity of the developer materials. The developer was tested in a fixture using a photoreceptor charged negatively and good quality prints were obtained.

EXAMPLE II

Toner B comprising 6 percent Regal 330 carbon black, 1.5 percent cetyl pyridinium chloride, and 92.5 percent styrene n-butyl methacrylate 65/35 copolymer was prepared by melt blending followed by mechanical attrition. The toner was classified to remove particles having diameters below 5 microns. Three parts of classified Toner B and 100 parts of 1.6 percent of FPC 461 a fluorocarbon polymer commercially available from Firestone Polymer Company coated hoeganaes steel carrier were blended into a developer. The developer was tested in a fixture using a photoreceptor charged negatively. Prints of excellent quality and low background were obtained.

EXAMPLE III

Toner C comprising 6 percent of cetyl pyridinium chloride treated Regal 330 carbon black, 1 percent of cetyl pyridinium chloride and 93 percent styrene/n-butyl methacrylate 65/35 copolymer resin was prepared by melt blending folowed by mechanical attrition. Three parts of this toner and 100 parts of 0.35 perfluoroalkoxy fluoropolymer commercially available from DuPont Company coated Hoeganaes steel carrier were placed in a glass jar and roll milled at a linear speed of 90 feet per minute. The triboelectric charges of this toner as a function of mixing time were as follows:

| Roll Mixing Time | Toner Tribo μc/gram (microcoulombs per gram) |
|---|---|
| 5 min. | +37 |
| 10 min | +38 |
| 1 hr | +37 |
| 24 hr | +40 |

The toner was fast charging against the carrier and the tribo was stable. Transmission electron microscopic work showed the Toner C had excellent carbon black dispersion and particle-to-particle uniformity.

EXAMPLE IV

Toner D comprising 10% Regal 330 carbon black, 3% cetyl pyridinium chloride, and 87% styrene/n-butyl methacrylate (65/35) copolymer resin was prepared by melt blending followed by mechanical attrition. The toner was classified to remove particles having diameters below 5 microns. Three parts of classified Toner D and 100 parts of 0.4% Kynar 201 vinylidene fluoride resin coated atomized steel carrier were blended into a developer. The developer was tested in a fixture using a photoreceptor charged negatively and produced prints of excellent quality.

EXAMPLE V

Toner E comprising 25% Mapico Black magnetite available from Cities Service Co., 3% cetyl pyridinium chloride, and 72% styrene/n-butyl methacrylate (65/35) copolymer resin is prepared by melt blending followed by mechanical attrition. The toner was classified to remove particles having diameters below 5 microns. Three parts of classified Toner E and 100 parts of 0.2 percent Kynar 20 vinylidene fluoride resin coated atomized steel carrier were blended into a developer. The developer was tested in a fixture using a photoreceptor charged negatively. Prints of good quality and low background were obtained.

Other modifications of the present invention will occur to those skilled in the art upon a reading of the present disclosure. These are intended to be included within the scope of this invention.

What is claimed is:

1. A positively charged dry particulate electrostatic toner composition in combination with a particulate carrier, said toner consisting essentially of a resin component, a pigment component and from about 0.1 to 10 percent based on the weight of toner of an alkyl pyridinium compound or its hydrate of the formula:

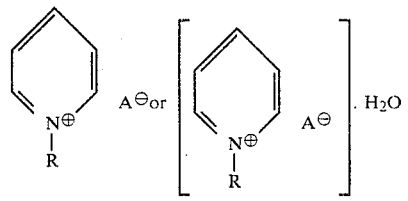

wherein R is a hydrocarbon radical containing from about 15 to about 18 carbon atoms, and A is chloride or bromide.

2. A composition in accordance with claim 1 wherein the pigment is coated with the alkyl pyridinium compound.

3. A composition in accordance with claim 1 wherein the alkyl pyridinium compound is cetyl pyridinium chloride.

4. A composition in accordance with claim 1 wherein the resin used is a styrene copolymer of n-butyl methacrylate, the pigment used is carbon black and the alkyl pyridinium compound used is cetyl pyridinium chloride.

5. A composition in accordance with claim 1 wherein the resin is a copolymer of styrene/n-butyl methacrylate and the pigment is magnetite.

6. A composition in accordance with claim 1 wherein the carrier is selected from perfluoroalkoxy fluoropolymer coated Hoeganaes steel carrier, and vinylidene fluoride resin coated steel carrier.

7. A method of imaging comprising forming a negative electrostatic latent image on a photoreceptor, contacting the image with a positively charged dry particulate electrostatic toner, and carrier, the toner consisting essentially of a resin material, a pigment material and about from 0.1 to 10 weight percent based on the weight of toner of an alkyl pyridinium compound or its hydrate of the formula:

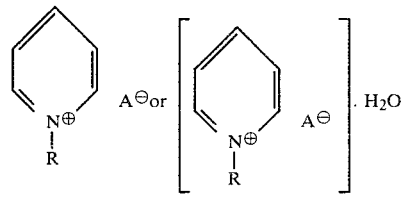

wherein A is chloride or bromide and R is a hydrocarbon radical containing from about 15 to about 18 carbon atoms, and subsequently transferring the developed latent image to a permanent substrate and permanently affixing the image thereto.

8. A method in accordance with claim 7 wherein the alkyl pyridinium compound is coated on the pigment.

9. A method in accordance with claim 7 wherein the alkyl pyridinium compound is cetyl pyridinium chloride.

10. A method in accordance with claim 7 wherein the resin is a copolymer of styrene n-butyl methacrylate, the pigment is carbon black, and the alkyl pyridinium compound is cetyl pyridinium chloride.

11. A method in accordance with claim 7 wherein the pigment is magnetite.

12. The invention in accordance with claim 1 or 7 wherein the alkyl pyridinium compound is blended with the toner resin.

* * * * *